US007090117B2

(12) United States Patent
Lackey et al.

(10) Patent No.: US 7,090,117 B2
(45) Date of Patent: Aug. 15, 2006

(54) GROUND MOUNT POST

(75) Inventors: Robert W. Lackey, Hickory, NC (US); Robert C. Beckmann, Vail, NC (US)

(73) Assignee: RWL Corporation, Hickory, NC (US)

( * ) Notice: Subject to any disclaimer, the term of this patent is extended or adjusted under 35 U.S.C. 154(b) by 0 days.

(21) Appl. No.: 11/024,265

(22) Filed: Dec. 28, 2004

(65) Prior Publication Data

US 2006/0138208 A1 Jun. 29, 2006

(51) Int. Cl.
*A47G 29/12* (2006.01)

(52) U.S. Cl. ..... 232/39; 248/156

(58) Field of Classification Search ..... 232/39; 248/146, 156, 150, 151; 256/65.14; D99/32
See application file for complete search history.

(56) References Cited

U.S. PATENT DOCUMENTS 2,172,742 A * 9/1939 Matthai ..... 232/39
5,620,136 A * 4/1997 Erwin et al. ..... 232/39
5,626,317 A * 5/1997 Altman ..... 248/121
5,664,729 A * 9/1997 Ladewig ..... 232/39
5,971,267 A * 10/1999 Beckmann ..... 232/39
6,575,423 B1 * 6/2003 Erwin ..... 248/533
6,722,561 B1 * 4/2004 Thomas et al. ..... 232/39
6,883,285 B1 * 4/2005 Chen ..... 52/309.9

FOREIGN PATENT DOCUMENTS

AU 2004100904 * 12/2004

* cited by examiner

*Primary Examiner*—William L. Miller
(74) *Attorney, Agent, or Firm*—Charles L. Schwab; Nexsen Pruet LLC

(57) ABSTRACT

An elongated vertical plastic ground mount post for mailboxes is provided having an upper portion suitable for supporting a mailbox, as by insertion into a hollow support column of a plastic mailbox, and a lower portion with vertically spaced notches which serve to retain the post in place in the ground when earth is compacted against the lower portion.

3 Claims, 2 Drawing Sheets

GROUND MOUNT POST

BACKGROUND OF THE INVENTION

Rural mailboxes are usually mounted on vertical wooden posts, which are subjected to deterioration through decay or termite attack. Also, the typical square or round wooden mailbox post can be loosened and lifted out of the ground by pranksters—much to the irritation and inconvenience of the mailbox owner and mail delivery personnel.

BRIEF SUMMARY OF THE INVENTION

An elongated plastic ground mount post is provided for supporting a mailbox. The post has a substantially square cross section and a lower portion with scalloped corners forming notches, which are filled with earth or gravel when installed. By tamping the soil and/or gravel of the earth around the post upon installation, the packed earth in the area of the notches affords considerable resistance to any attempt to remove the post. By forming the post of a suitable strong plastic, deterioration of the post is avoided and a strong installation is provided which resists accidental or vandal like destruction.

BRIEF DESCRIPTION OF THE DRAWINGS

The invention is illustrated in the accompanying drawings, in which.

DETAILED DESCRIPTION OF THE INVENTION

Figure 1:
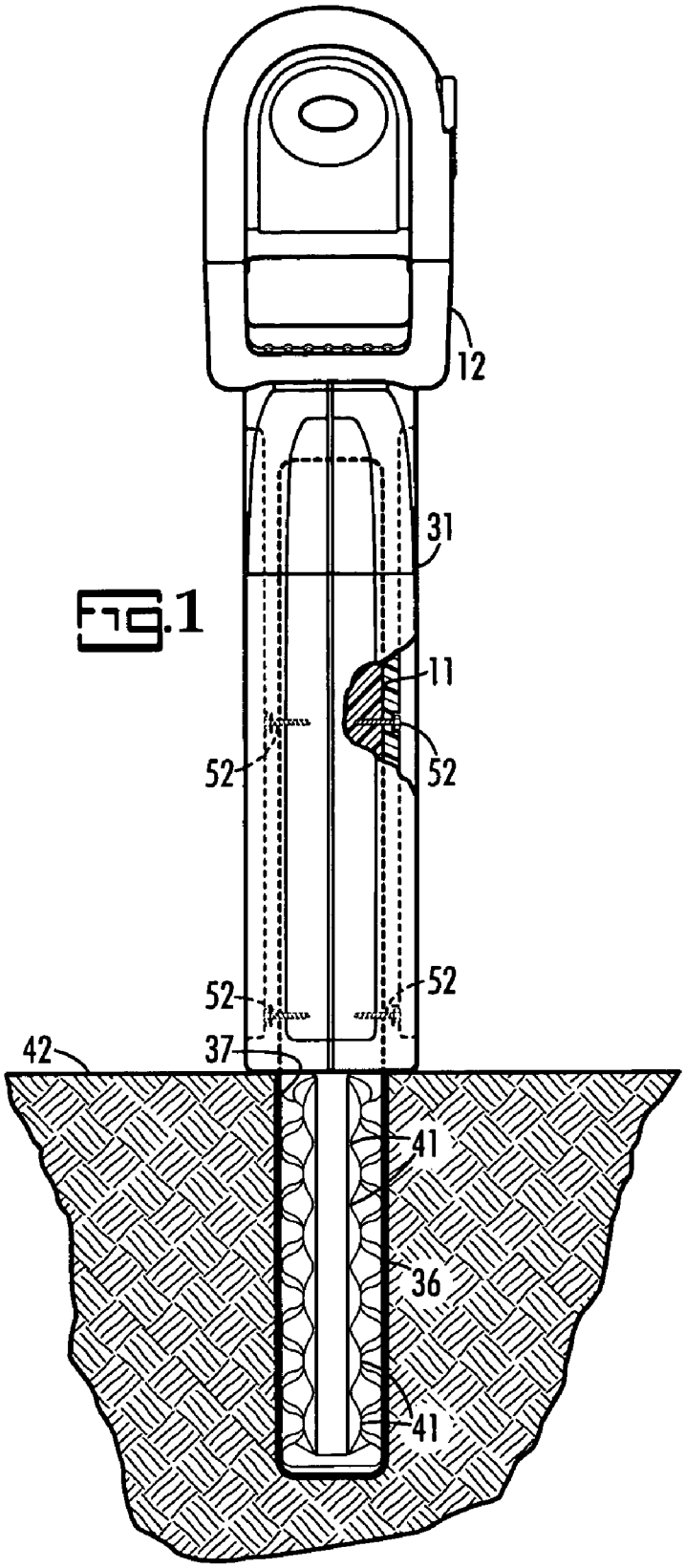
FIG. 1 is a front view showing a plastic mailbox mounted on the plastic ground mount post of this invention.
Figure 2:
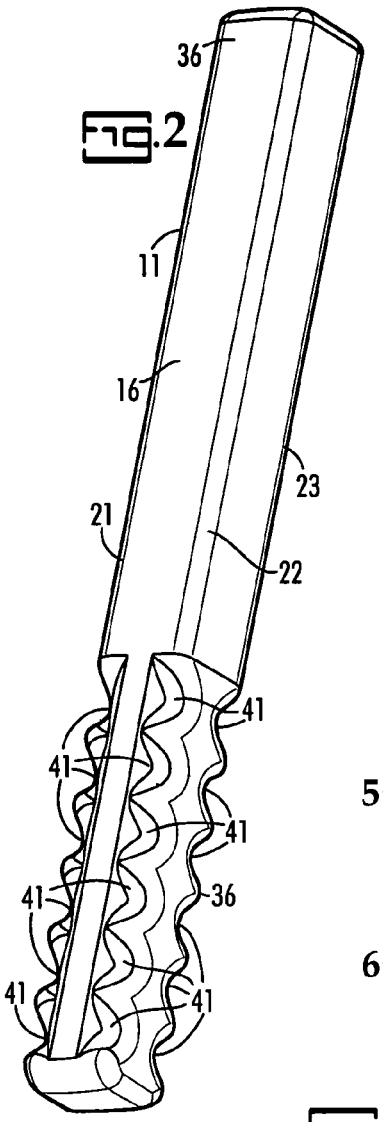
FIG. 2 is a perspective view of the ground mount post.
Figure 3:
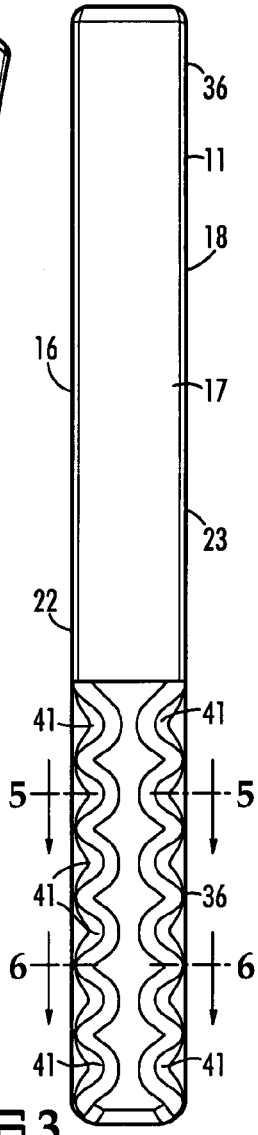
FIG. 3 is a side view of the ground mount post.
Figure 4:
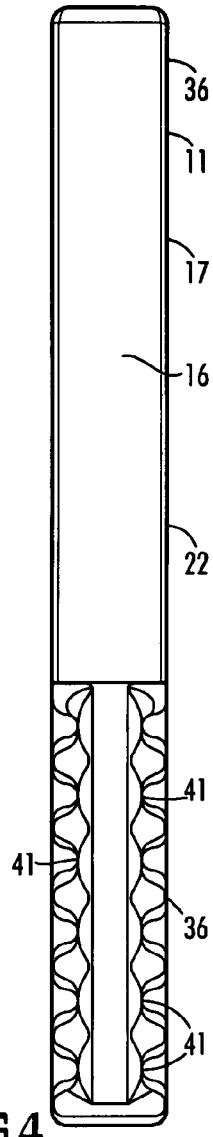
FIG. 4 is a rear view of the ground mount post.
Figure 5:
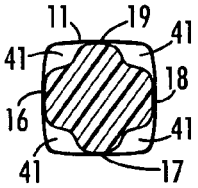
FIG. 5 is a section taken on line 5—5 in FIG. 3.
Figure 6:
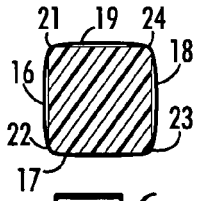
FIG. 6 is a section taken on line 6—6 in FIG. 3.

Referring to FIG. 1, an elongated vertical ground mount post 11 is illustrated supporting a plastic mailbox 12. The detailed construction of the ground mount post 11, which is made of polyethylene, is shown in FIGS. 2–6. The elongated plastic post 11 has four exterior sides or side surfaces 16, 17, 18, 19 extending in the direction of its elongation and defining a substantially square or quadrilateral shape. The four corners of the post 11 are beveled or rounded to form rounded corners or rounds 21, 22, 23, 24. The top and bottom of the post 11 also have rounded corners or edges to facilitate insertion into an opening in the hollow column 31 of the plastic mailbox 12 and the hole 37 in the ground 42.

A four corners of the lower portion 36 of the post 11 have a plurality of vertically spaced indentations or notches 41 which form recesses extending slightly more than one third of the way into the sides 16, 17, 18, 19. The notches 41 form pockets for soil or gravel tamped or packed around the post 11 installed in the hole 37 in the ground 42, thus providing resistance to removal of the post 11. The upper portion 51 of the post 11 is releasably secured to the hollow post receiving support column 31 of the plastic mailbox 12 by suitable fasteners such as screws 52.

Figure 7:
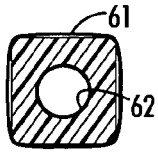
FIG. 7 is a section similar to FIG. 6 but showing an alternate construction.

FIG. 7 is a section through a post 61 of alternate construction which has a hollow interior formed by a round opening 62 extending between its opposite ends. This construction saves material and weight without a substantial sacrifice of strength.

The plastic ground mount post 11 is suitable for mounting a plastic mailbox of the type having a hollow support column such as shown in FIG. 1. It is strong. It is relatively easy is install and provides an exceptionally long life since it does not deteriorate because of rot and it is not subject to attack by termites and the like.

What is claimed is:

1. A plastic mailbox assembly comprising in combination:

a mailbox;

a hollow support column supporting said mailbox, an elongated vertical ground mount post having four exterior side surfaces extending in the direction of elongation and defining a substantially square cross section shape with four rounded corners and an upper portion and a lower portion, said upper portion being disposed in said hollow support column and said lower portion having a plurality of vertically spaced notches in each of its corners extending less than all the way through said exterior side surfaces, said lower portion being adapted for insertion in a hole in the ground and said notches servicing to resist vertical withdrawal of said post when said lower portion is placed in said hold and upon earth being compacted against said lower portion.

2. The combination of claim 1 wherein said post is made of plastic.

3. The combination of claim 1 wherein said post has a hollow interior formed by an opening extending between its opposite ends.

* * * * *